US008438771B1

(12) United States Patent
Boone

(10) Patent No.: US 8,438,771 B1
(45) Date of Patent: May 14, 2013

(54) DETACHABLE PISTOL STOCK

(76) Inventor: Andrew J. Boone, Milford, KS (US)

( * ) Notice: Subject to any disclaimer, the term of this patent is extended or adjusted under 35 U.S.C. 154(b) by 0 days.

(21) Appl. No.: 13/486,546

(22) Filed: Jun. 1, 2012

(51) Int. Cl.
*F41C 23/12* (2006.01)

(52) U.S. Cl.
USPC ..... 42/72

(58) Field of Classification Search ..... 42/71.01, 42/71.02, 72, 73, 74
See application file for complete search history.

(56) References Cited

U.S. PATENT DOCUMENTS

| | | | | | |
|---|---|---|---|---|---|
| 22,626 | A | * | 1/1859 | Colt | 42/72 |
| 517,555 | A | * | 4/1894 | Reed | 42/72 |
| 1,554,556 | A | * | 9/1925 | Camus | 42/72 |
| 1,557,865 | A | * | 10/1925 | Neel et al. | 42/72 |
| 3,609,902 | A | * | 10/1971 | Casull | 42/62 |
| 3,685,194 | A | * | 8/1972 | Coon | 42/77 |
| 3,861,273 | A | | 1/1975 | Seidel et al. | |
| 4,887,374 | A | * | 12/1989 | Santarossa | 42/73 |
| 4,896,446 | A | | 1/1990 | Gregory | |
| 5,092,070 | A | * | 3/1992 | Perkins | 42/71.02 |
| 5,924,233 | A | * | 7/1999 | Strobel | 42/72 |
| 7,398,616 | B1 | | 7/2008 | Weir | |
| 7,552,557 | B1 | * | 6/2009 | Mabry | 42/72 |
| 7,849,626 | B2 | | 12/2010 | Fluhr | |

* cited by examiner

*Primary Examiner* — Gabriel Klein

(57) ABSTRACT

A detachable pistol stock that includes a stock member having a butt, a comb disposed between a heel and a forearm recess, a pistol grip disposed proximal a fore-end, a fore stock attached to a fore-end notch disposed underlying the pistol grip, wherein an extant pistol is releasably supportable within a receiving tray and compressibly engagable with a padded bracket disposed on the fore-end by a shooter's grip, whereby the detachable pistol stock is rapidly deployable and usable with an extant pistol, as desired, to increase accuracy in using said pistol.

3 Claims, 5 Drawing Sheets

DETACHABLE PISTOL STOCK

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Figure 1:
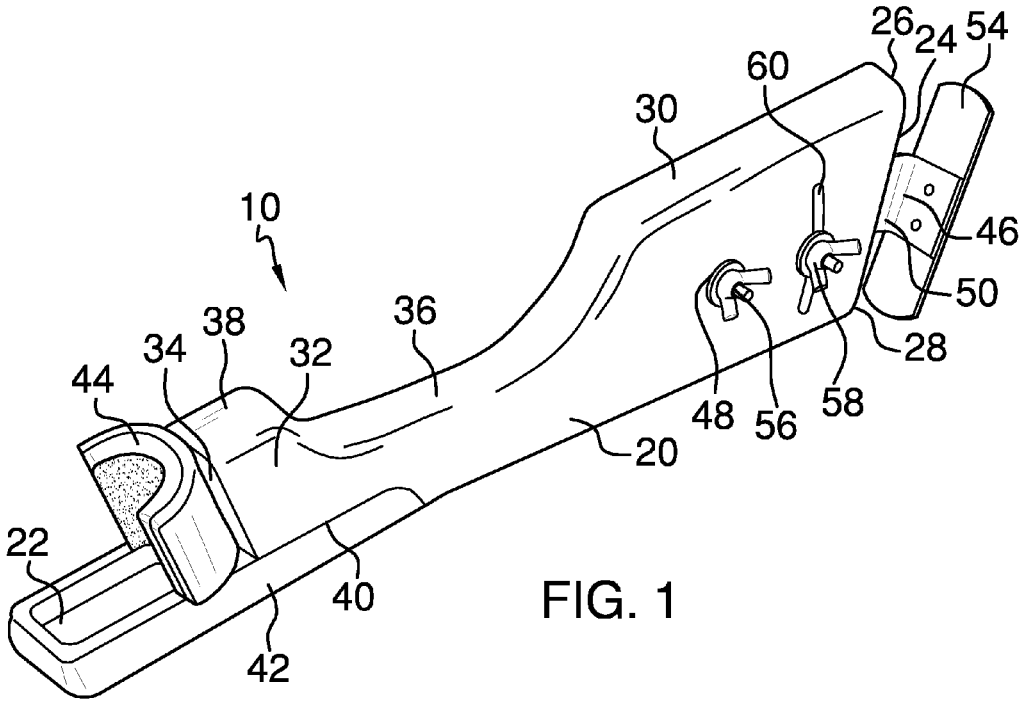

Various types of attachable pistol stocks are known in the prior art. However, what is needed is a detachable pistol stock that includes a stock member having a butt, a comb disposed between a heel and a forearm recess, a pistol grip disposed proximal a fore-end, a fore stock, attached to a fore-end notch, disposed underlying the pistol grip, wherein an extant pistol is releasably supported within a receiving tray and compressibly engaged with a padded bracket disposed on the fore-end by a shooter's grip, whereby the detachable pistol stock is rapidly deployable and usable with an extant pistol, as desired.

FIELD OF THE INVENTION

The present invention relates to a detachable pistol stock, and more particularly, to a detachable pistol stock that includes a stock member having a butt, a comb disposed between a heel and a forearm recess, a pistol grip disposed proximal a fore-end, a fore stock, attached to a fore-end notch, disposed underlying the pistol grip, wherein an extant pistol is releasably supported within a receiving tray and compressibly engaged with a padded bracket disposed on the fore-end by a shooter's grip, whereby the detachable pistol stock is rapidly deployable and usable with an extant pistol, as desired.

SUMMARY OF THE INVENTION

The general purpose of the detachable pistol stock, described subsequently in greater detail, is to provide a detachable pistol stock which has many novel features that result in a detachable pistol stock which is not anticipated, rendered obvious, suggested, or even implied by prior art, either alone or in combination thereof.

Accurately discharging a pistol can be challenging. What is needed is a detachable pistol stock that rapidly deploys to releasably support a pistol firmly engaged by a shooter's shoulder. While stocks useable with pistols are seen in the prior art, what is needed is a detachable pistol stock that includes a receiving tray disposed upon a fore stock wherein an extant pistol is releasably supported against a padded bracket by the hands of a shooter.

The present invention, therefore, includes a stock member having a butt, a comb, a forearm recess, a pistol grip, a fore-end, and a fore stock connected to a fore-end notch disposed underlying the pistol grip. For greater comfort in using the device, an adjustable shoulder mount is included, said adjustable shoulder mount disposed extending rearwards from the butt by means of a first and a second bolt releasably engaging with a hoop member.

The receiving tray provides a recessed area into which a handle of an extant pistol may be supported. The padded bracket, disposed on the fore-end, releasably engages with the rear of the pistol handle. A shooter is thereby enabled to hold the pistol firmly and securely within the receiving tray, said pistol firmly positional within the padded bracket. The padded bracket presents a soft surface forwards with which the pistol handle may releasably engage when held in a firing position within the receiving tray. The padded bracket assists absorbing the recoil of the pistol when the pistol is fired. The padded bracket also prevents damage (such as scratching or scuffing) to the pistol when using the detachable pistol stock.

The adjustable shoulder mount includes a hoop member with a central channel disposed therein. The adjustable shoulder mount is disposed parallel the stock member of the detachable pistol stock. The hoop member is releasably securable at a desired position by means of the first and second bolts releasably engaging with the hoop member through the central channel. The first bolt is disposed at a pivot point upon which the adjustable shoulder mount is pivotally moveable. The adjustable shoulder mount is extensible rearwards when the first and second bolts are loosened, the hoop member slidingly extensible by means of the central channel. Once positioned at a desired extension, each of the first bolt and second bolt is tightened, and the adjustable shoulder mount releasably secured at a desired position thereby.

A vertically-oriented aperture is disposed in the stock member. The vertically-oriented aperture is disposed slightly curved relative the butt 24. The second bolt is releasably securable within the vertically-oriented aperture and the adjustable shoulder mount is thereby releasably securable at a desired angle relative the pivot point. Thusly, the adjustable shoulder mount is positional in a desired position relative the butt and the stock member to conform to the stature and preference of an individual user. The adjustable shoulder mount includes a butt member disposed endwise on the hoop member, said butt member disposed perpendicular with respect to the hoop member, whereby the adjustable shoulder mount is configured to conform to a shooter's shoulder and be supportable thereat.

A hook member is disposed upon the adjustable shoulder mount whereby the detachable pistol stock is dependable from, for example, a person's belt, or a position suitable for storage of the device. The hook member is attached to the hoop member, and curls to parallel the hoop member towards a position proximal the second bolt. The hook member is disposed outfacing from the stock member and the detachable pistol stock is dependable thereby.

An alternative embodiment is included in this specification wherein an extant pistol is releasably securable within the receiving tray, as may be desired by a particular shooter. The alternative embodiment is substantially similar to the preferred embodiment disclosed hereinabove, however it includes a means for releasably securing the pistol to the fore-end. A fore bracket is included, the fore bracket configured to releasably engage with the front of an extant pistol's handle, below the trigger guard. The fore bracket therefore engages with the pistol handle and secures the pistol to the padded bracket. A screw pin is included by which the fore bracket is movably securable, as desired, when fitting a particular pistol to the receiving tray.

The preferred embodiment enables rapid deployment of a pistol, and releasably supports said pistol when firing. The preferred embodiment is easily converted to the alternative embodiment by means of the fore stock. The fore stock of each embodiment is connected to the stock member by means of a fore-end notch disposed underlying the pistol grip. Interchanging the fore stock enables a shooter to utilize either embodiment herein disclosed.

Thus has been broadly outlined the more important features of the present detachable pistol stock so that the detailed description thereof that follows may be better understood and in order that the present contribution to the art may be better appreciated.

Objects of the present detachable pistol stock, along with various novel features that characterize the invention are particularly pointed out in the claims forming a part of this disclosure. For better understanding of the detachable pistol stock, its operating advantages and specific objects attained by its uses, refer to the accompanying drawings and description.

BRIEF DESCRIPTION OF THE DRAWINGS FIGURES

Figure 2:
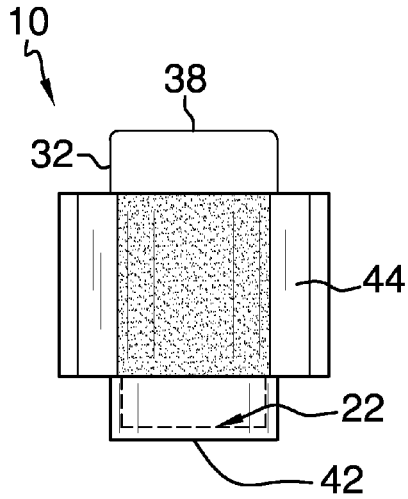
Figure 3:
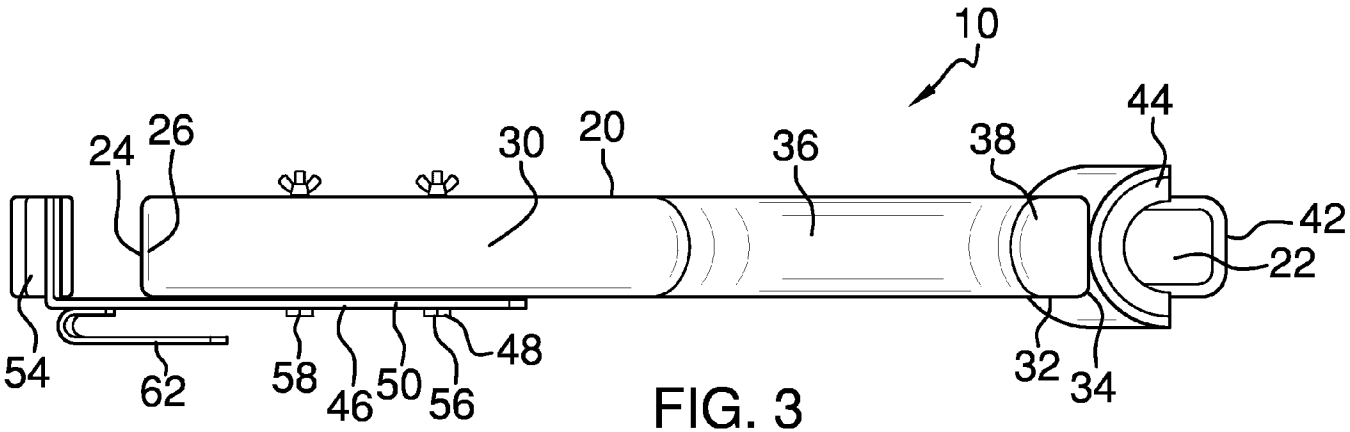
Figure 4:
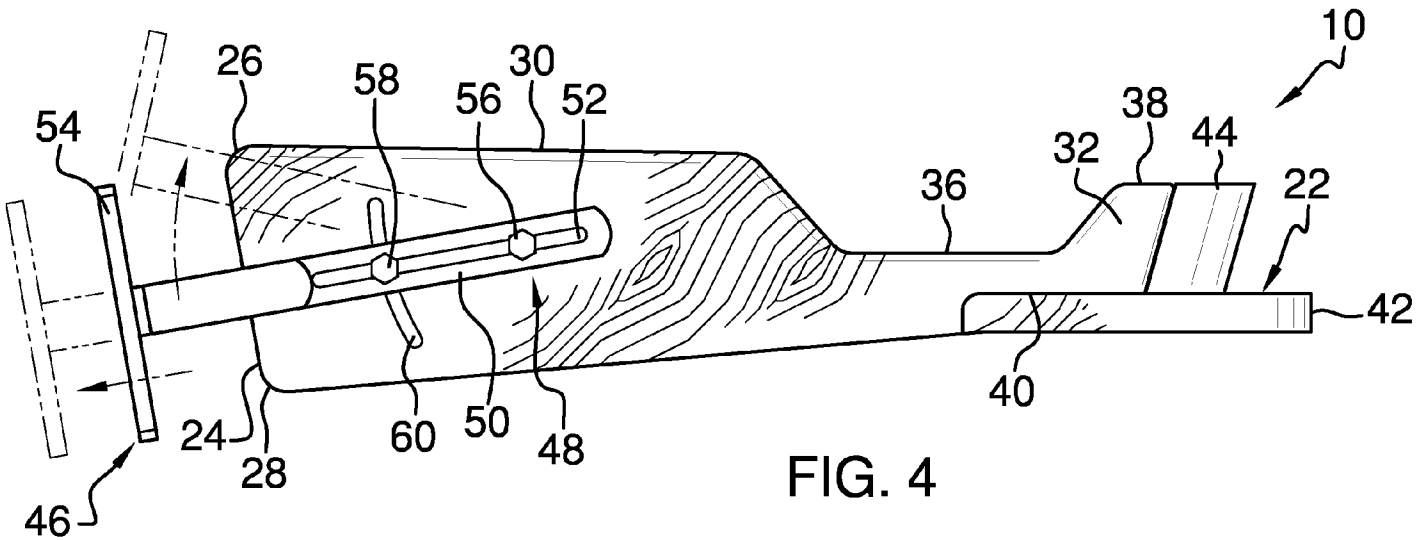
Figure 5:
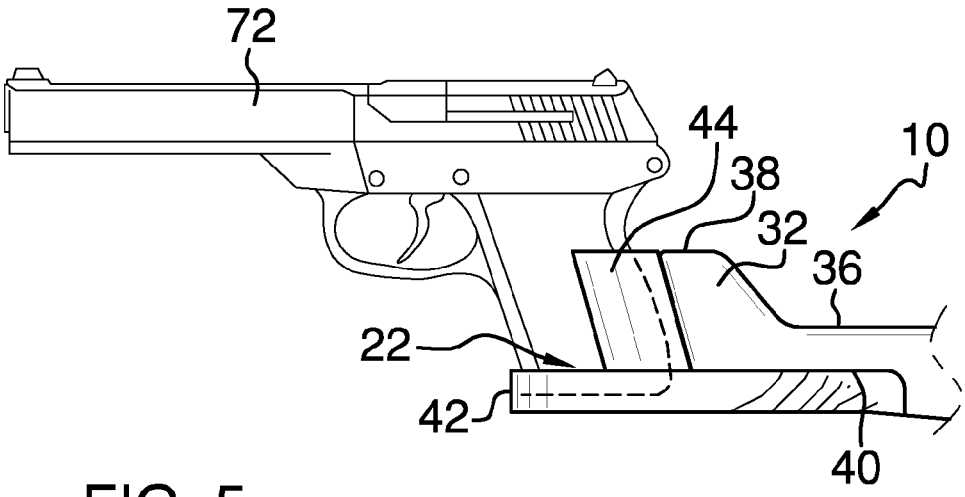
Figure 6:
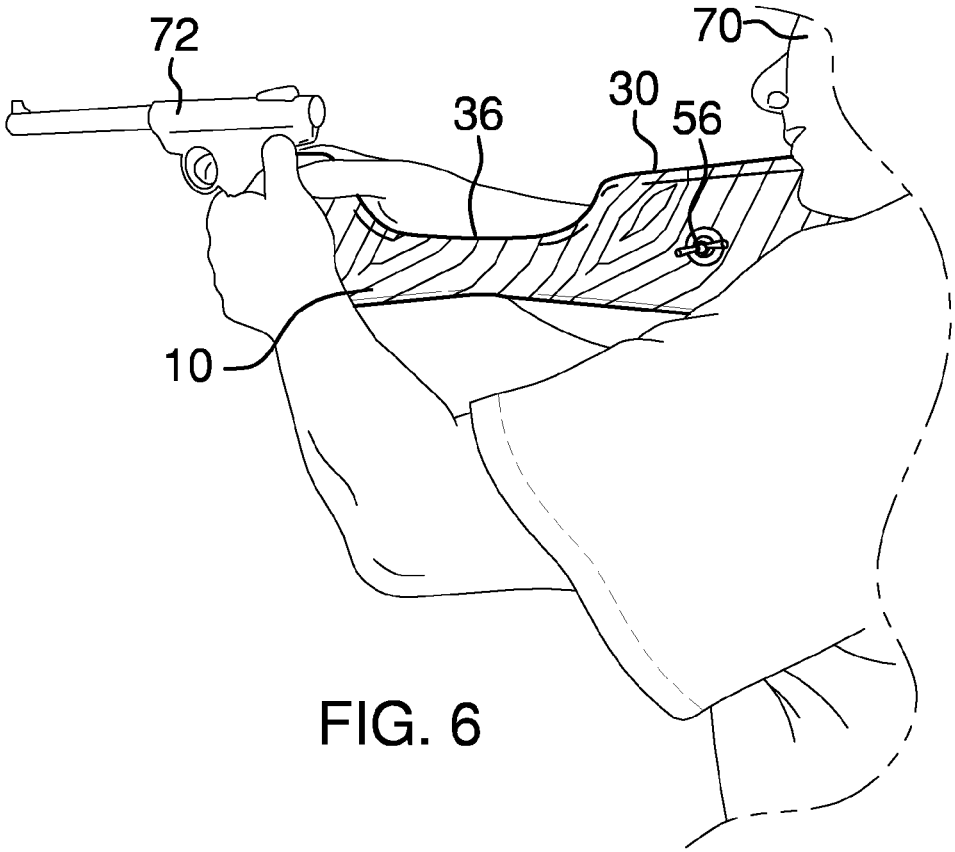
Figure 7:
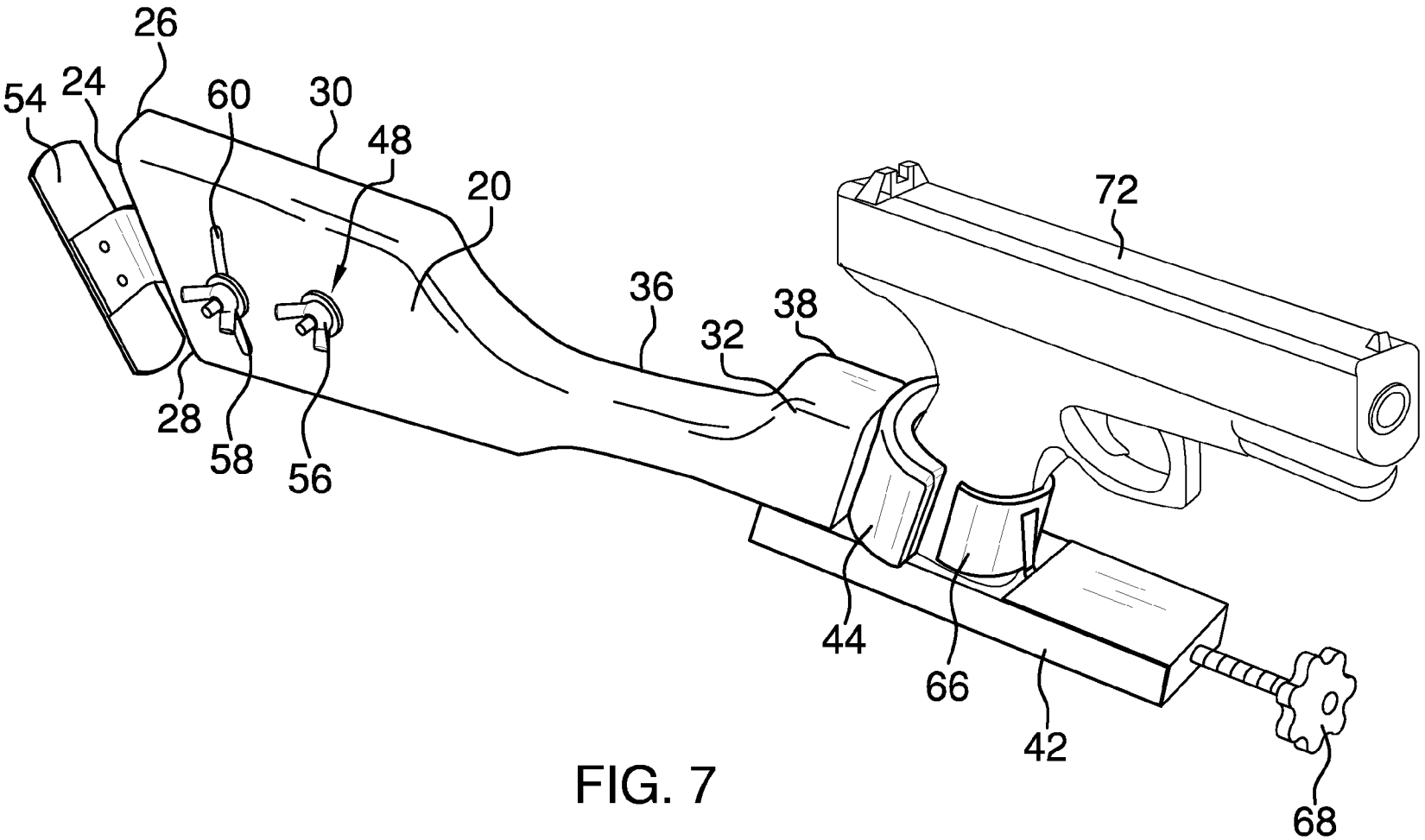
Figure 8:
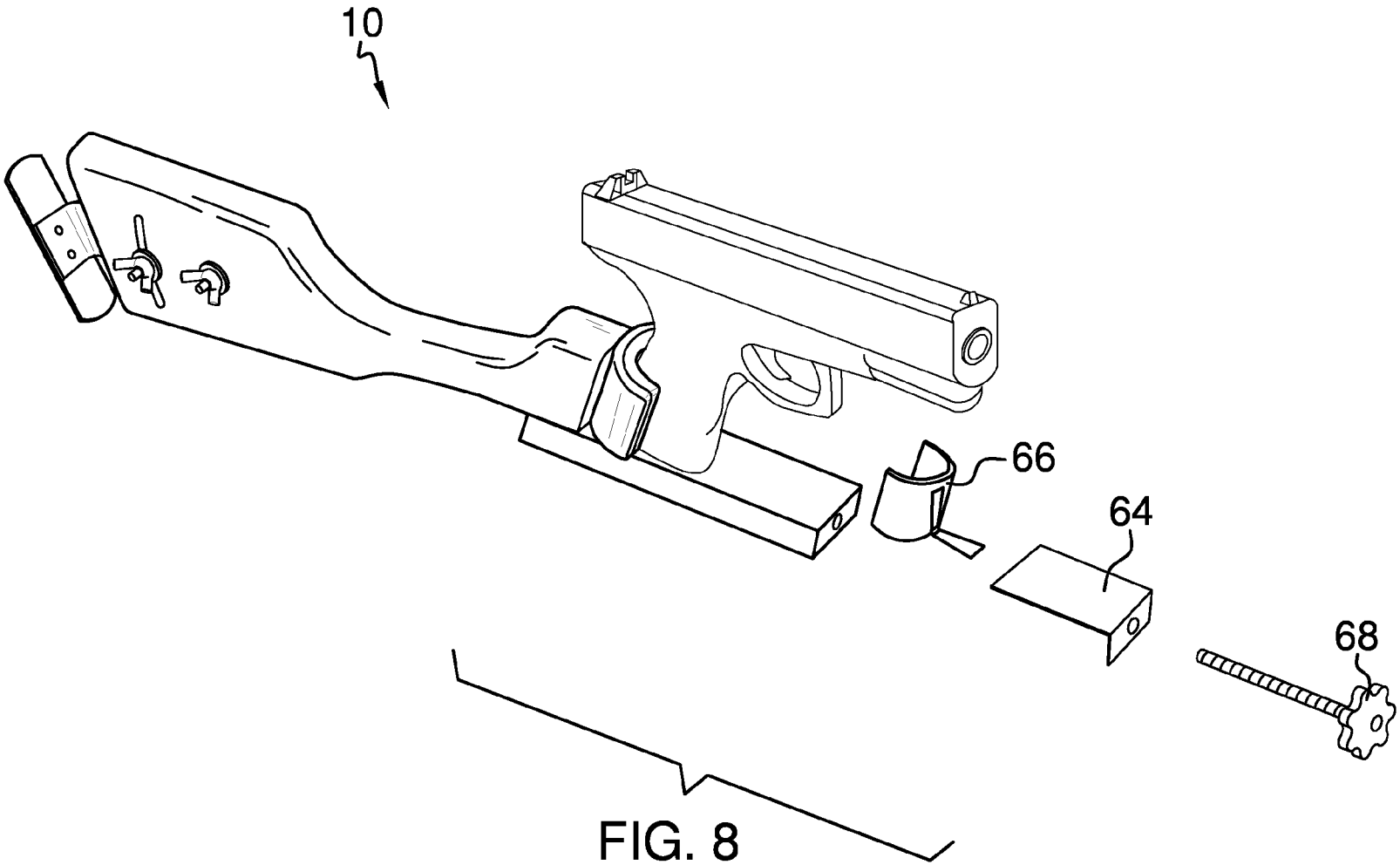

FIG. 1 is an isometric view of an embodiment.
FIG. 2 is a front view of an embodiment.
FIG. 3 is a top view of an embodiment.
FIG. 4 is a side view of an embodiment.
FIG. 5 is an in use view of an embodiment.
FIG. 6 is an in use view of an embodiment.
FIG. 7 is an isometric view of an alternative embodiment.
FIG. 8 is an exploded view of an alternative embodiment.

DETAILED DESCRIPTION OF THE DRAWINGS

With reference now to the drawings, and in particular FIGS. 1 through 8 thereof, example of the instant detachable pistol stock employing the principles and concepts of the present detachable pistol stock and generally designated by the reference number 10 will be described.

Referring to FIGS. 1 through 8 a preferred embodiment of the present detachable pistol stock 10 is illustrated.

The present detachable pistol stock 10 has been devised to releasably support a pistol 72 to increase accuracy when discharging said pistol 72. The term "pistol", as used throughout this specification, is taken to mean a handgun, a revolver, a pistol, or any other such hand held firearm useable with the device 10 as disclosed herein. A preferred embodiment is disclosed first, with an alternative embodiment disclosed thereafter, said alternative embodiment comprising a simple alteration to the preferred embodiment wherein a pistol 72 is releasably securable to the detachable pistol stock 10.

Discussing now the preferred embodiment, as illustrated in FIGS. 1 through 6, the detachable pistol stock 10 includes a stock member 20 and a receiving tray 22. The stock member 20 includes a butt 24 having a heel 26 and a toe 28. A comb 30 is disposed at approximately 84 degrees relative the butt 24.

A pistol grip 32 is disposed proximal to a fore-end 34. A forearm recess 36 is disposed between the comb 30 and the pistol grip 32, the forearm recess 36 configured to enable a shooter's 70 forearm to comfortably engage with the detachable pistol stock 10 when the shooter's 70 firing hand is placed to grasp the pistol grip 32 (see FIG. 6). The pistol grip 32 includes a top surface 38. The top surface 38 is disposed in a plane parallel with the comb 30.

The fore-end 34 is disposed at approximately 65 degrees relative the pistol grip 32 top surface 38. A fore-end notch 40 is disposed underlying the pistol grip 32 in a plane parallel with the pistol grip 32 top surface 38. A fore stock 42 is disposed within the fore-end notch 40. The fore stock 42 extends forwards from the fore-end notch 40. The receiving tray 22 is disposed atop the fore stock 42 and a padded bracket 44 is disposed upon the fore-end 34, said bracket 44 configured to releasably engage with an extant pistol 72 handle therein.

The receiving tray 22 provides a recessed area into which an extant pistol 72 handle is releasably supportable. The padded bracket 44 provides a surface against which the extant pistol 72 handle may be squeezed and releasably secured to steady said pistol 72 when discharging the pistol 72.

For greater comfort and increased accuracy when using the device 10, an adjustable shoulder mount 46 is pivotally attached and releasably securable upon the stock member 20 at a pivot point 48, said shoulder mount 46 extending rearwards from the butt 24. The shoulder mount 46 includes a hoop member 50 disposed adjacent the stock member 20, a central channel 52 centrally disposed within the hoop member 50, and a butt member 54 disposed perpendicularly endwise upon the hoop member 50. A first bolt 56 is disposed through the pivot point 48, said first bolt 56 releasably securable within the central channel 52 of the hoop member 50. The adjustable shoulder mount 46 is thereby positionally securable by means of the first bolt 56 releasably engaging with the hoop member 50. A second bolt 58 is disposed through a vertically-oriented aperture 60 disposed in the stock member 20 slightly curved relative the butt 24, said second bolt 58 releasably securing the hoop member 50 at a desired position along said vertical channel 60 and angularly with respect to the pivot point 48.

A hook member 62 is disposed upon the hoop member 50, said hook member 62 disposed connected to the hoop member 50 proximal the butt member 54 and curled therefrom to parallel the hoop member 50 toward a position proximal the second bolt 58 whereby the detachable pistol stock 20 is dependable therefrom. The detachable pistol stock 20 is thereby easily carried depending from a belt, for example, or stored hanging conveniently by means of the hook member 62.

The detachable pistol stock 20 releasably supports a pistol 72 in the receiving tray 22 and a shooter 70 secures said pistol 72 within the receiving tray 22 by holding said pistol 72 abutting the padded bracket 44. The pistol 72 is releasably positioned upon the receiving tray 22 of the detachable pistol stock 10 by the hands of the shooter 70 and the adjustable shoulder mount 46 adjustably conforms to the shoulder of the shooter 70, whereby the pistol 72 is more accurately discharged by said shooter 70 when supported by the detachable pistol stock 10 (see FIG. 6).

In the preferred embodiment herein disclosed, the following approximate dimensions are considered. The comb 30 is 22.9 cm (9 inches) long, the top surface 38 of the pistol grip 32 is 2.5 cm (1 inch) long, and the forearm recess 36 is 11.4 cm (4.5 inches) long, recessing to a depth of 2.9 cm (1 and ⅛ inches) relative the comb 30 and pistol grip 32 top surface 38. The fore-end 34 is 6.4 cm (2.5 inches) long, the fore-end 34 disposed at a 65 degree angle relative the pistol grip 32 top surface 38. The fore-end notch 40 is disposed 7.6 cm (3 inches) from the fore-end 34, and extends rearwards. The butt 24 is 12.1 cm (4 and ¾ inches) in length, disposed at an 84 degree angle relative the comb 30. The vertically-oriented aperture 60 is disposed at 3.8 cm (1.5 inches) from the butt 24, and runs slightly curved with respect thereto. The pivot point 48 is considered as a 1 cm (⅜ inch) diameter hole.

The alternative embodiment is substantially similar to the preferred embodiment disclosed hereinabove, except that the alternative embodiment provides means to releasably secure the extant pistol to the fore-end 34, as may be desired with extended use of the detachable pistol stock 10 (see FIGS. 7 and 8). The alternative embodiment, therefore, includes a base plate 64 mounted atop the fore stock 42 and a fore bracket 66 moveably disposed to contact the front of a handle of an extant pistol 72 positioned within the receiving tray 22 (see FIGS. 7 and 8). A screw pin 68 is rotatably disposed within the fore stock 42, said screw pin 68 manually operable to movingly engage said fore bracket 66 with said front of handle of the pistol 72. The fore bracket 66 releasably secures said pistol 72 to the fore stock 42.

What is claimed is:

1. A detachable pistol stock comprising:

a stock member comprising:

a butt having a heel and a toe;

a comb;

a pistol grip;

a forearm recess disposed between the comb and the pistol grip;

a securable and adjustable shoulder mount pivotally attached to the stock at a pivot point, said shoulder mount extending rearwards from the butt;

a fore-end;

a fore stock disposed within the fore-end and extending forwards therefrom;

a receiving tray disposed atop the fore stock, said receiving tray configured to releasably support an extant pistol handle thereupon;

a padded bracket disposed upon the fore-end, said bracket configured to releasably engage an extant pistol handle therein;

wherein the detachable pistol stock is adapted to releasably support an extant pistol within the receiving tray while a shooter secures said pistol within the receiving tray by holding said pistol abutting the padded bracket such that the pistol is releasably secured to the detachable pistol stock by the hands of the shooter and the stock member adjustably conforms to a shoulder of a shooter;

a fore-end notch;

wherein the fore stock is further disposed within the fore-end notch;

a vertically-oriented aperture disposed within the stock member, said vertically-oriented aperture disposed between the pivot point and the butt wherein the adjustable shoulder mount is releasably securable along a radius extending rearwards from the pivot point, said radius delimited angularly between the extremes of said vertically-oriented aperture by means of a fastener disposed therein;

wherein the adjustable shoulder mount is extensible from the pivot point, said adjustable shoulder mount comprising:

a hoop member disposed adjacent the stock member;

a central channel centrally disposed within the hoop member;

a butt member disposed perpendicularly endwise upon the hoop member;

a first bolt disposed through the pivot point, said first bolt releasably securable within the central channel of the hoop member;

a second bolt disposed through the vertically-oriented aperture, said second bolt releasably securing the hoop member at a desired position along the vertical channel and angularly with respect to the pivot point;

a hook member disposed upon the hoop member, said hook member disposed connected to the hoop member proximal the butt member and curled therefrom to parallel the hoop member toward a position proximal to the second bolt;

wherein the adjustable shoulder mount is extensible rearward from the stock member when the first and second bolt are loosened, and thereby securable in a desired extension; and wherein the adjustable shoulder mount is positional and securable angularly from the stock member along a radius extending from the pivot point, said radius angularly delimited by the vertically-oriented aperture, and securable thereat by means of the second bolt.

2. A detachable pistol stock comprising:

a stock member comprising:

a butt having a heel and a toe;

a comb disposed at approximately 84 degrees relative the butt;

a pistol grip having a top surface, said top surface disposed in parallel with the comb;

a forearm recess disposed between the comb and the pistol grip;

a securable and adjustable shoulder mount pivotally attached to the stock at a pivot point, said shoulder mount extending rearwards from the butt, said shoulder mount comprising:

a hoop member disposed adjacent the stock member;

a central channel centrally disposed within the hoop member;

a butt member disposed perpendicularly endwise upon the hoop member;

a first bolt disposed through the pivot point, said first bolt releasably securable within the central channel of the hoop member;

a second bolt disposed through the vertically-oriented aperture, said second bolt releasably securing the hoop member at a desired position along the vertical channel and angularly with respect to the pivot point;

a hook member disposed upon the hoop member, said hook member disposed connected to the hoop member proximal the butt member and curled therefrom to parallel the hoop member toward a position proximal to the second bolt where by the detachable pistol stock is dependable therefrom;

a fore-end disposed at approximately 65 degrees relative the pistol grip top surface;

a fore-end notch disposed underlying the pistol grip top surface;

a fore stock disposed within the fore-end notch and extending forwards therefrom;

a receiving tray disposed atop the fore stock;

a padded bracket disposed upon the fore-end, said bracket configured to releasably engage with an extant pistol handle therein;

wherein the detachable pistol stock is adapted to releasably support an extant pistol within the receiving tray while a shooter secures said pistol within the receiving tray by holding said pistol abutting the padded bracket such that the pistol is releasably secured to the detachable pistol stock by the hands of the shooter and the stock member adjustably conforms to a shoulder of a shooter, such that the pistol is more accurately discharged by said shooter when supported by the detachable pistol stock.

3. The detachable pistol stock of claim 2 wherein the fore stock further comprises:

a base plate mounted atop the fore stock;

a fore bracket moveably disposed to contact the front of a handle of the extant pistol positioned within the receiving tray;

a screw pin rotatably disposed within the fore stock, said screw pin manually operable to movingly engage said fore bracket with said front of handle of the firearm;

wherein the fore bracket is adapted to releasably secure said extant pistol to the fore stock.

* * * * *